US005679504A

United States Patent [19]

Büscher et al.

[11] Patent Number: 5,679,504

[45] Date of Patent: Oct. 21, 1997

[54] COLOR PHOTOGRAPHIC SILVER HALIDE MATERIAL

[75] Inventors: Ralf Büscher, Lohmar; Peter Bell, Köln; Johannes Willsau, Leverkusen; Hans-Ulrich Borst, Elsdorf, all of Germany

[73] Assignee: Agfa-Gevaert Aktiengesellschaft, Germany

[21] Appl. No.: 567,913

[22] Filed: Dec. 6, 1995

[30] Foreign Application Priority Data

Dec. 16, 1994 [DE] Germany ..... 44 44 867.8

[51] Int. Cl.[6] ..... G03C 1/46

[52] U.S. Cl. ..... 430/504; 430/509; 430/543; 430/559; 430/567; 430/359

[58] Field of Search ..... 430/504, 509, 430/543, 559, 567, 359

[56] References Cited

U.S. PATENT DOCUMENTS 4,023,970 5/1977 Hellmig et al. ..... 430/509
4,036,646 7/1977 Hellmig et al. ..... 430/509

*Primary Examiner*—Geraldine Letscher
*Attorney, Agent, or Firm*—Connolly & Hutz

[57] ABSTRACT

A color photographic silver halide material which contains as photosensitive layers on a support at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, in which, above a photosensitive layer (seen from the support outwards), at least one further layer is provided which contains a colorless compound or combination of colorless compounds, which under processing conditions after exposure gives rise to a uniform, slight color density of a predetermined color and predetermined density over the entire surface, allows correction of the print densities without sensitivity being reduced.

4 Claims, No Drawings

COLOR PHOTOGRAPHIC SILVER HALIDE MATERIAL

This invention relates to a colour photographic silver halide material with corrected differences of the print density of the three colours, the sensitivity of which material is not reduced by the correction.

If colour density is plotted on a diagram against exposure of a colour photographic material, in particular a colour negative film (log H against D with H=I·t, I being light intensity, t time and D colour density), the so-called characteristic curves for blue, green and red light are obtained (c.f. Ullmann's Encyclopedia of Industrial Chemistry, volume A 20, VCH Publishers Inc. (1992), page 104), which, for each log H value, should be spaced relative to each other at a certain distance which is established for each type of film, as otherwise the printer, which is adjusted to these preset values, does not produce satisfactory colour prints.

In practice, over the course of their production, colour negative films exhibit deviations with regard to these differences, which are offset by the purposeful addition of filter dyes. Since these filter dyes absorb light, they reduce the sensitivity of the material if they are located above the photosensitive layers (seen from the support outwards). Efforts are therefore made wherever possible to use these dyes beneath the lowermost photosensitive layer, but this is not always possible if the deviation from the required difference is or can be noticed only once the first photosensitive layers have been poured.

Difference correction of print density in a colour photographic material is thus accompanied by a loss of sensitivity. The object of the invention was to provide the possibility of difference correction of colour density in a layer which is arranged above the photosensitive layers, in particular above the uppermost layer which is spectrally sensitised for green light, preferably above all the photosensitive layers of a colour photographic material, in particular a colour negative film, which correction does not, however, diminish the sensitivity of the material.

It has now been found that this object may be achieved by adding to such a layer a colourless compound or combination of colourless compounds, which under processing conditions gives rise to a uniform, slight colour density of a desired colour over the entire surface of the material.

In a preferred embodiment, this is the leuco (colourless) form of a dye, which is converted into the dye form under the conditions of a processing bath, in particular of the bleaching or bleaching/fixing bath.

In another preferred embodiment, this is the combination of a colourless colour coupler, which couples with the developer oxidation product to yield a dye of the desired colour and of the desired density, and a non spectrally sensitised, fogged silver halide emulsion.

Colour couplers which may preferably be used are the colour couplers used in the photosensitive layers of the material. Mixtures of two or more couplers, which couple to yield not only identical but also different dyes, may also be used.

The fogged silver halide emulsion is preferably a particularly fine grained emulsion, in particular such an emulsion with an elevated chloride content, for example an $AgCl_{0.9-1}Br_{0-0.1}$ emulsion, the particles of which have a diameter of a sphere of equal volume of 0.05 to 0.12 μm.

The combination is preferably used in a layer which is not reached by the developer oxidation product of the most closely adjacent photosensitive layer and the developer oxidation product of which combination does not reach the most closely adjacent photosensitive layer. This may, for example, be achieved by providing between these two layers an interlayer which may if necessary contain a so-called DOP scavenger, i.e. a reducing compound.

The combination according to the invention of coupler and fogged emulsion is preferably used in the following quantities: 0.01 to 0.08 mmol coupler/$m^2$ and 0.2 to 0.6 mmol of silver halide/$m^2$.

If a leuco dye is used, it is employed in a quantity of 0.01 to 0.08 mmol/$m^2$.

According to the invention, the colour densities produced by the further layer should be 0.01 to 0.1.

The material according to the invention is in particular a colour photographic silver halide material having a support, at least one red-sensitive silver halide emulsion layer containing at least one cyan coupler, at least one green-sensitive silver halide emulsion layer containing at least one magenta coupler, at least one blue-sensitive silver halide emulsion layer containing at least one yellow coupler, wherein all green-sensitive silver halide emulsion layers are arranged closer to the support than all blue-sensitive silver halide emulsion layers and all red-sensitive emulsion layers are arranged closer to the support than all green-sensitive emulsion layers. A yellow filter layer is conventionally located between the blue-sensitive and green-sensitive emulsion layers. The active constituent of this filter layer may be colloidal silver or a yellow dye, which it must be possible to decolorise or rinse out. Such dyes are known from the literature.

The material preferably contains 2 or 3 blue-sensitive, green-sensitive and red-sensitive layers.

Suitable transparent supports for the production of colour photographic materials are, for example, films and sheet of semi-synthetic and synthetic polymers, such as cellulose nitrate, cellulose acetate, cellulose butyrate, polystyrene, polyvinyl chloride, polyethylene terephthalate, polyethylene naphthalate and polycarbonate. These supports may also be coloured black for light-shielding purposes. The surface of the support is generally subjected to a treatment in order to improve the adhesion of the photographic emulsion layer, for example corona discharge with subsequent application of a substrate layer. The reverse side of the support may be provided with a magnetic layer and an antistatic layer.

The essential constituents of the photographic emulsion layers are the binder, silver halide grains and colour couplers.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinyl pyrrolidone, polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkyl cellulose, carboxymethyl cellulose and phthalyl cellulose together with gelatine derivatives obtained by reaction with alkylating or acylating agents or by grafting polymerisable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. The production of such gelatines is described, for example, in *The Science and Technology of Gelatine,* edited by A. G. Ward and A. Courts, Academic Press 1977, pages 295 et seq.. The gelatine used in each case should have a content of photographically active impurities which is as low as possible (inert gelatine). Gelatines with high viscosity and low swelling are particularly advantageous.

The silver halide present as the photosensitive constituent in the photographic material may contain chloride, bromide or iodide or mixtures thereof as the halide. For example, the halide content of at least one layer may consist of 0 to 15 mol. % of iodide, 0 to 20 mol. % of chloride and 65 to 100 mol. % of bromide. The silver halide crystals may be predominantly compact, for example regularly cubic or octahedral, or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains deviate by no more than ±30% from the average grain size. The emulsions may, in addition to the silver halide, also contain organic silver salts, for example silver benzotriazolate or silver behenate.

Two or more types of silver halide emulsions which are produced separately may be used as a mixture.

The photographic emulsions may be produced by various methods (for example P. Glafkides, *Chimie et Physique Photographique,* Paul Montel, Paris (1967), G. F. Duffin, *Photographic Emulsion Chemistry,* The Focal Press, London (1966), V. L. Zeiikman et al., *Making and Coating Photographic Emulsion,* The Focal Press, London (1966)) from soluble silver salts and soluble halides.

On completion of crystal formation, or also at an earlier point in time, the soluble salts are eliminated from the emulsion, for example by noodling and washing, by flocculation and washing, by ultrafiltration or by ion exchangers.

The silver halide emulsion is generally subjected to chemical sensitisation under defined conditions—pH, pAg, temperature, gelatine concentration, silver halide concentration and sensitiser concentration—until optimum sensitivity and fog are achieved. The procedure is described in, for example, H. Frieser, *Die Grundlagen der Photographischen Prozesse mir Silberhalogeniden* [The principles of photographic processes with silver halides], pages 675–734, Akademische Verlagsgesellschaft (1968).

At this stage, chemical sensitisation may proceed with the addition of compounds of sulphur, selenium, tellurium and/or compounds of metals of subgroup VIII of the periodic table (for example gold, platinum, palladium, iridium), furthermore there may be added thiocyanate compounds, surface-active compounds, such as thioethers, heterocyclic nitrogen compounds (for example imidazoles, azaindenes) or also spectral sensitisers (described, for example, in F. Hamer, *The Cyanine Dyes and Related Compounds,* 1964, or *Ullmanns Encyclopädie der technischen Chemie* [Ullmann's encyclopaedia of industrial chemistry], 4th edition, volume 18, pages 431 et seq., and *Research Disclosure* 17643 (December 1978), section III). Alternatively or additionally, reduction sensitisation may be performed by adding reducing agents (tin(II) salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilise the photographic function during production, storage or photographic processing.

Particularly suitable are azaindenes, preferably tetra- and pentaazaindenes, particularly those substituted with hydroxyl or amino groups. Such compounds have been described, for example, by Birr, *Z. Wiss. Phot.,* 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (December 1978), section VI.

The stabilisers may be added to the silver halide emulsions before, during or after ripening of the emulsions. Naturally, the compounds may also be added to other photographic layers which are associated with a silver halide layer.

Mixtures of two or more of the stated compounds may also be used.

The photographic emulsion layers or other hydrophilic colloidal layers of the photosensitive material produced according to the invention may contain surface-active agents for various purposes, such as coating auxiliaries, to prevent formation of electric charges, to improve sliding properties, to emulsify the dispersion, to prevent adhesion and to improve photographic characteristics (for example acceleration of development, high contrast, sensitisation etc.). Apart from natural surface-active compounds, for example saponin, it is mainly synthetic surface-active compounds (surfactants) which are used: non-ionic surfactants, for example alkylene oxide compounds, glycerol compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, for example a carboxytic acid, sulphonic acid, phosphoric acid, sulphuric acid ester or phosphoric acid ester group, ampholytic surfactants, for example amino acid and aminosulphonic acid compounds together with sulphuric or phesphoric acid esters of an amino alcohol.

The photographic emulsions may be spectrally sensitised by using methine dyes or other dyes. Particularly suitable dyes are cyanine dyes, merocyanine dyes and complex merocyanine dyes.

A review of the polymethine dyes suitable as spectral sensitisers, suitable combinations of the dyes and the combinations with supersensitising effects is contained in *Research Disclosure* 17643, December 1978, section IV.

In particular, the following dyes—classified by spectral range—are suitable:

1. as red sensitisers 9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines, provided that the dyes bear at least one sulphoalkyl group on the heterocyclic nitrogen.

2. as green sensitisers 9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.

3. as blue sensitisers symmetrical or asymmetrical benzimidiazo-, oxa-, thia- or selenocyanines with at least one sulphoalkyl group on the heterocyclic nitrogen and optionally further substituents on the aromatic ring, together with apomerocyanines with a rhodanine group.

The differently sensitised emulsion layers are associated with non-diffusing monomeric or polymeric colour couplers which may be located in the same layer or in an adjacent layer. Usually, cyan couplers are associated with the red-sensitive layers, magenta couplers with the green-sensitive layers and yellow couplers with the blue-sensitive layers.

Colour couplers to produce the cyan partial colour image are generally couplers of the phenol or α-naphthol type.

Colour couplers to produce the magenta partial colour image are generally couplers of the pyrazolone or pyrazolotriazole type.

Colour couplers to produce the yellow partial colour image are generally couplers of the acylacetanilide type.

The colour couplers may be 4-equivalent couplers, but they may also be 2-equivalent couplers. The latter are differentiated from 4-equivalent couplers by containing a substituent at the coupling site which is eliminated on coupling. 2-equivalent couplers are considered to be those which are colourless, as well as those which have an intense intrinsic colour which on colour coupling disappears or is replaced by the colour of the image dye produced (masking couplers), and white couplers which, on reaction with colour developer oxidation products, give rise to substantially colourless products. 2-equivalent couplers are further considered to be those which contain an eliminable residue at the coupling site, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator. Examples of such 2-equivalent couplers are the known DIR couplers as well as DAR or FAR couplers.

DIR couplers which release azole type development inhibitors, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages for colour reproduction, i.e. colour separation and colour purity, and for the reproduction of detail, i.e. sharpness and grain, are to be achieved with such DIR couplers, which, for example, do not release the development inhibitor immediately as a consequence of coupling with an oxidised colour developer, but instead only after a further subsequent reaction, which is, for example, achieved with a time control group. Examples of this are described in DE-A-28 55 697, 32 99 671, 38 18 231, 35 18 797, in EP-A-0 157 146 and 0 204 175, in U.S. Pat. Nos. 4,146,396 and 4,438,393 and in GB-A-2 072 363.

DIR couplers which release a development inhibitor which is decomposed in the developer bath to substantially photographically inactive products are, for example, described in DE-A-32 09 486 and EP-A-0 167 168 and 0 219 713. By this means, unproblematic development and processing consistency are achieved.

When DIR couplers are used, particularly those which eliminate a readily diffusible development inhibitor, improvements in colour reproduction, for example more differentiated colour reproduction, may be achieved by suitable measures during optical sensitisation, as are described, for example, in EP-A-0 115 304, 0 167 173, GB-A-2 165 058, DE-A-37 00 419 and U.S. Pat. No. 4,707,436.

The DIR couplers may, in a multi-layer photographic material, be added to the most various layers, for example also to non-photosensitive layers or interlayers. Preferably, however, they are added to the photosensitive silver halide emulsion layers, wherein the characteristic properties of the silver halide emulsion, for example its iodide content, the structure of the silver halide grains or its grain size distribution influence the photographic properties achieved. The influence of the released inhibitors may, for example, be restricted by the incorporation of an inhibitor scavenging layer according to DE-A-24 31 223. For reasons of reactivity or stability, it may be advantageous to use a DIR coupler which on coupling forms a colour in the layer in which it is accommodated, which is different from the colour to be produced in this layer.

In order to increase sensitivity, contrast and maximum density, principally DAR or FAR couplers may be used which eliminate a development accelerator or fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. Nos. 4,618,572 and 4,656,123.

Reference is made to EP-A-193 389 as an example of the use of BAR couplers (bleach accelerator releasing couplers).

It may be advantageous to modify the effect of a photographically active group eliminated from a coupler by causing an intermolecular reaction of this group after its release with another group according to DE-A-35 06 805.

Since with the DIR, DAR or FAR couplers it is mainly the activity of the residue released on coupling that is desired and the chromogenic properties of these couplers are of lesser importance, those DIR, DAR or FAR couplers which give rise to substantially colourless products on coupling are also suitable (DE-A-15 47 640).

The eliminable residue may also be a ballast residue such that, on reaction with colour developer oxidation products, coupling products are obtained which are diffusible or have at least weak or restricted mobility (U.S. Pat. No. 4,420,556).

The material may, in addition to couplers, contain various compounds which, for example, may liberate a development inhibitor, a development accelerator, a bleach accelerator, a developer, a silver halide solvent, a fogging agent or an anti-fogging agent, for example so-called DIR hydroquinones and other compounds as, for example, described in U.S.

Pat. Nos. 4,636,546, 4,345,024, 4,684,604 and in DE-A-31 45 640, 25 15 213, 24 47 079 and in EP-A-198 438. These compounds fulfil the same function as the DIR, DAR or FAR couplers, except that they produce no coupling products.

High-molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high-molecular weight colour couplers are generally produced by polymerisation of ethylenically unsaturated monomeric colour couplers. They may, however, also be obtained by polyaddition or polycondensation.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular. solubility of the compound.

Methods for the introduction of compounds which are substantially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Pat. No. 2,322,027, U.S. Pat. No. 2,801,170, U.S. Pat. No. 2,801,171 and EP-A-0 043 037.

Oligomers or polymers, so-called polymeric oil formers, may be used instead of high-boiling solvents.

The compounds may also be introduced into the pouring solution in the form of filled letices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl p-hydroxybenzoate, diethyldodecanamide, N-tetradecylpyrrolidone, isostearyl alcohol, 2,4-di-t-amylphenol, dioctyl acelate, glycerol tributyrate, iso-stearyl lactate, trioctyl citrate, N,N-dibutyl-2-butoxy-5-t-octyl aniline, paraffin, dodecylbenzene and diisopropylnaphthalene.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable agents, which are also known as scavengers or DOP scavengers, are described in *Research Disclosure* 17 643 (December 1978), section VII, 17 842 (February 1979) and 18 716 (November 1979), page 650 and in EP-A-0 069 070, 0 098 072, 0 124 877, 0 125 522.

If there are several partial layers of the same spectral sensitisation, then they may differ in composition, particularly in terms of the type and quantity of silver halide grains. In general, the partial layer with the greater sensitivity will be located further from the support than the partial layer with lower sensitivity. Partial layers of the same spectral sensitisation may be adjacent to each other or may be separated by other layers, for example by layers of different spectral sensitisation. Thus, for example, all high sensitivity and all low sensitivity layers may be grouped together each in a package of layers (DE-A-19 58 709, DE-A-25 30 645, DE-A-26 22 922).

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Ultra-violet absorbing couplers (such as cyan couplers of the α-naphthol type) and ultra-violet absorbing polymers may also be used. These ultra-violet absorbents may be fixed into a specific layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* 17 643 (December 1978), section V, in U.S. Pat. Nos. 2,632,701, 3,269,840 and in GB-A-852 075 and 1 319 763.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-33 31 542, DE-A-34 24 893, *Research Disclosure* 17 543 (December 1978), section XVI).

The average particle diameter of the spacers is in particular in the range from 0.2 to 10 μm. The spacers are insoluble in water and may be soluble or insoluble in alkali, wherein alkali-soluble spacers are generally removed from the photographic material in the alkaline developing bath. Examples of suitable polymers are polymethyl methacrylate, copolymers of acrylic acid and methyl methacrylate together with hydroxypropylmethyl-cellulose hexahydrophthalate.

Additives to improve the stability of dyes, couplers and whites and to reduce colour fogging (*Research Disclosure* 17 543 (December 1978), section VII) may belong to the following classes of chemical substances: hydroquinones, 6-hydroxychromans, 5-hydroxycoumarans, spirochromans, spiroindans, p-alkoxyphenols, sterically hindered phenols, gallic acid derivatives, methylene-dioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in a single molecule (U.S. Pat. No. 4,268,593) are particularly effective in preventing the impairment of yellow colour images as a consequence of the development of heat, moisture and light. Spiroindans (JP-A-159 644/81) and chromans which are substituted by hydroquinone diethers or monoethers (JP-A-89 835/80) are particularly effective in preventing the impairment of magenta colour images, in particular their impairment due to the effects of light.

The layers of the photographic material according to the invention may be hardened with conventional hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A-974 723 and GB-A-1 167 207), divinylsulphone compounds, 5-acetyl-1, 3-diacryloylhexahydro-1,3,5-triazine and other compounds containing a reactive olefin bond (U.S. Pat. No. 3,635,718, U.S. Pat. No. 3,232,763 and GB-A-994 869); N-hydroxymethyl-phthalimide and other N-methylol compounds (U.S. Pat. No. 2,732,316 and U.S. Pat. No. 2,586, 168); isocyanates (U.S. Pat. No. 3,103,437); aziridine compounds (U.S. Pat. No. 3,017,280 and U.S. Pat. No. 2,983, 611); acid derivatives (U.S. Pat. No. 2,725,294 and U.S. Pat. No. 2,725,295); compounds of the carbodiimide type (U.S. Pat. No. 3,100,704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds with two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halogen carboxyaldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the pouring solution for the layer to be hardened, or by overcoating the layer to be hardened with a layer containing a diffusible hardener.

There are included in the classes listed slow acting and fast acting hardeners as well as so-called instant hardeners, which are particularly advantageous. Instant hardeners are taken to be compounds which harden suitable binders in such a way that immediately after pouring, at the latest after 24 hours, preferably at the latest after 8 hours, hardening is concluded to such an extent that there is no further alteration in the sensitometry and swelling of the layered structure determined by the crosslinking reaction. Swelling is taken to be the difference between the wet layer thickness and the dry layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which are capable of reacting with the free carboxyl groups of the gelatine, so that the latter react with free amino groups of the gelatine to form peptide bonds crosslinking the gelatine.

Colour photographic negative materials are conventionally processed by developing, bleaching, fixing and rinsing or by developing, bleaching, fixing and stabilising without subsequent rinsing, wherein bleaching and fixing may be combined into a single processing stage. Colour developer compounds which may be used are all developer compounds having the ability to react, in the form of their oxidation product, with colour couplers to form azomethine or indophenol dyes. Suitable colour developer compounds are aromatic compounds containing at least one primary amino group of the p-phenylenediamine type, for example N,N-dialkyl-p-pheneylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Further usable colour developers are, for example, described in *J. Amer. Chem. Soc.* 73, 3106 (1951) and G. Haist *Modern Photographic Processing,* 1979, John Wiley & Sons, New York, pages 545 et seq..

An acid stop bath or rinsing may follow after colour development.

Conventionally, the material is bleached and fixed immediately after colour development. Bleaches which may be used are, for example, Fe(III) salts and Fe(III) complex salts such as ferricyanides, dichromates, water soluble cobalt complexes. Iron(III) complexes of aminopolycarboxylic acids are particularly preferred, in particular for example complexes of ethylenediamine-tetraacetic acid, propylenediaminetetraacetic acid, diethylenetriaminepentaacetic acid, nitrilotriacetic acid, iminodiacetic acid, N-hydroxyethylethylenediaminetriacetic acid, alkyliminodicarboxylic acids and of corresponding phosphonic acids. Persulphates and peroxides, for example hydrogen peroxide, are also suitable as bleaches.

Rinsing usually follows the bleaching-fixing bath or fixing bath, which is performed as countercurrent rinsing or comprises several tanks with their own water supply.

Favourable results may be obtained by using a subsequent finishing bath which contains no or only a little formaldehyde.

Rinsing may, however, be completely replaced with a stabilising bath, which is conventionally operated countercurrently. If formaldehyde is added, this stabilising bath also assumes the function of a finishing bath.

EXAMPLE 1

A colour photographic recording material for colour negative development (layer structure 1A) was produced by applying the following layers in the stated sequence onto a transparent cellulose triacetate film base. The stated quantities relate in each case to 1 $m^2$. The corresponding quantities of $AgNO_3$ are stated for the quantity of silver halide applied; the silver halfdes are stabilised with 0.5 g of 4-hydroxy-6-methyl-1,3,3a,7-tetraazaindene per mol of $AgNO_3$.

| | | |
|---|---|---|
| Layer 1 | (anti-halo layer) | |
| | 0.3 g | black colloidal silver |
| | 1.2 g | gelatine |
| | 0.4 g | UV absorber UV 1 |
| | 0.02 g | tricresyl phosphate (TCP) |
| Layer 2 | (interlayer) | |
| | 1.0 g | gelatine |
| Layer 3 | (low sensitivity red-sensitive layer) | |
| | 2.7 g | $AgNO_3$ of spectrally red-sensitised Ag(Br,I) emulsion with 4 mol. % iodide, average grain diameter 0.5 μm |
| | 2.0 g | gelatine |
| | 0.88 g | colourless coupler C1 |
| | 0.02 g | DIR coupler D1 |
| | 0.05 g | coloured coupler RC-1 |
| | 0.07 g | coloured coupler YC-1 |
| | 0.75 g | TCP |
| Layer 4 | (high sensitivity red-sensitive layer) | |
| | 2.2 g | $AgNO_3$ of spectrally red-sensitised Ag(Br,I) emulsion, 12 mol. % iodide, |

-continued

| | | |
|---|---|---|
| | | average grain diameter 1.0 μm |
| | 1.8 g | gelatine |
| | 0.19 g | colourless counter C2 |
| | 1.17 g | TCP |
| Layer 5 | (interlayer) | |
| | 0.4 g | gelatine |
| | 0.15 g | white coupler W-1 |
| | 0.06 g | aluminium salt of aurinetricarboxylic acid |
| Layer 6 | (low sensitivity green-sensitive layer) | |
| | 1.9 g | $AgNO_3$ of spectrally green-sensitised Ag(Br,I) emulsion, 4 mol. % iodide, average grain diameter 0.35 μm |
| | 1.8 g | gelatine |
| | 0.54 g | colourless coupler M-1 |
| | 0.24 g | DIR coupler D-1 |
| | 0.065 g | coloured coupler YM-1 |
| | 0.6 g | TCP |
| Layer 7 | (high sensitivity green-sensitive layer) | |
| | 1.25 g | $AgNO_3$ of spectrally green-sensitised Ag(Br,I) emulsion, 9 mol. % iodide, average grain diameter 0.8 μm, |
| | 1.1 g | galatine |
| | 0.195 g | colourless coupler M-2 |
| | 0.05 g | coloured coupler YM-2 |
| | 0.245 g | TCP |
| Layer 8 | (yellow filter layer) | |
| | 0.09 g | yellow, colloidal silver |
| | 0.25 g | gelatine |
| | 0.08 g | scavenger SC1 |
| | 0.40 g | formaldehyde scavenger FF-1 |
| | 0.08 g | TCP |
| Layer 9 | (low sensivity blue-sensitive layer) | |
| | 0.9 g | of spectrally blue-sensitised Ag(Br,I) emulsion, 6 mol. % iodide, average grain diameter 0.6 μm |
| | 2.2 g | gelatine |
| | 1.1 g | colourless coupler Y-1 |
| | 0.037 g | DIR coupler D-1 |
| | 1.14 g | TCP |
| Layer 10 | (high sensitivity blue-sensitive layer) | |
| | 0.6 g | $AgNO_3$ of spectrally blue-sensitised Ag(Br,I) emulsion, 10 mol. % iodide, average grain diameter 1.2 μm |
| | 0.6 g | gelatine |
| | 0.2 g | colourless coupler Y-1 |
| | 0.003 g | DIR coupler D-1 |
| | 0.22 g | TCP |
| Layer 11 | (interlayer) | |
| | 0.5 g | gelatine |
| Layer 12 | (micrate layer) | |
| | 0.06 g | $AgNO_3$ of micrate Ag (Br,I) emulsion, average grain diameter 0.06 μm, 0.5 mol. % iodide |
| | 1 g | gelatine |
| | 0.3 g | UV absorber UV-2 |
| | 0.3 g | TCP |
| Layer 13 | (protective and hardening layer) | |
| | 0.25 g | gelatine |
| | 0.75 g | hardener of the formula |

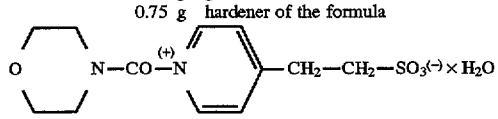

such that the total layer structure had a swelling factor of ≦3.5 after hardening.

Substances used in example 1:

UV-1

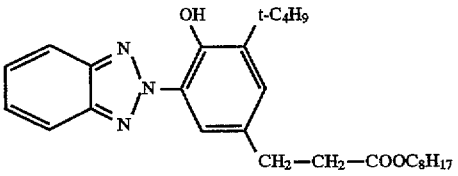

UV-2

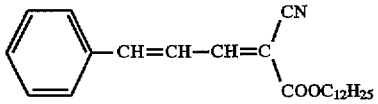

C-1

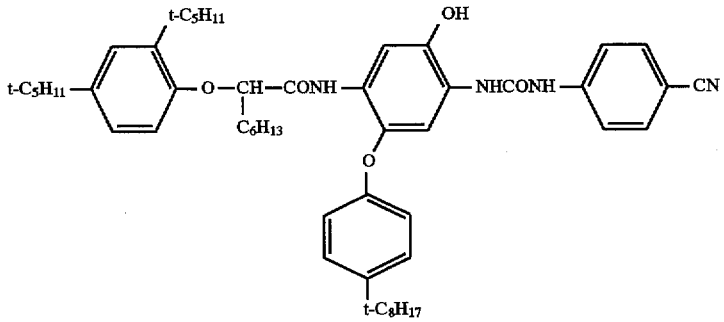

C-2

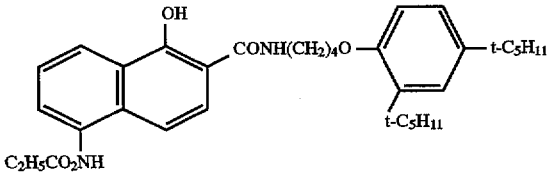

-continued
RC-1
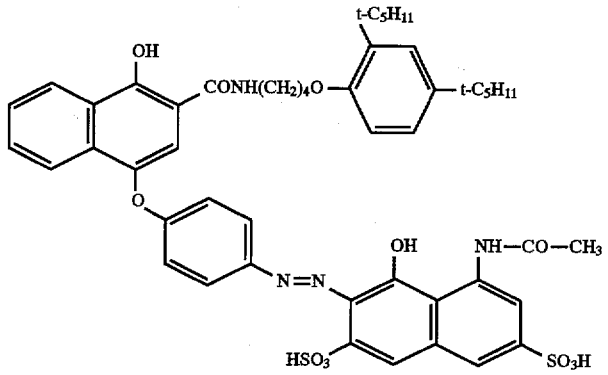
M-1
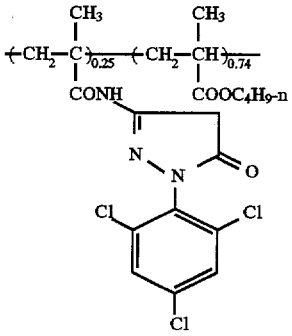
M-2
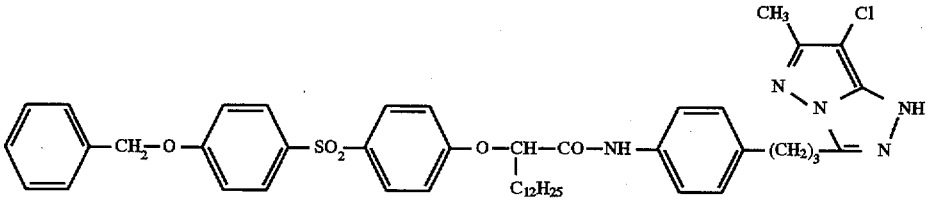
YM-1
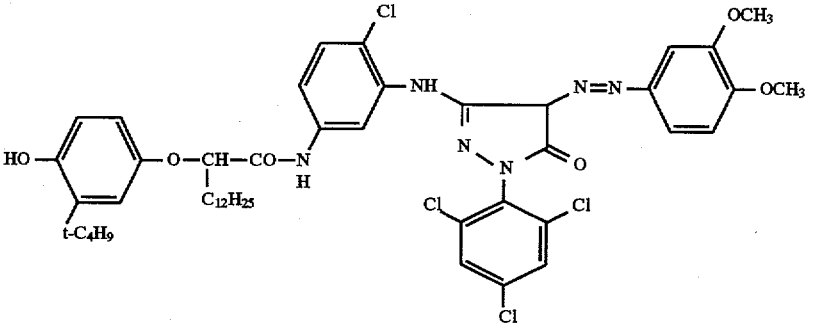
Y-1
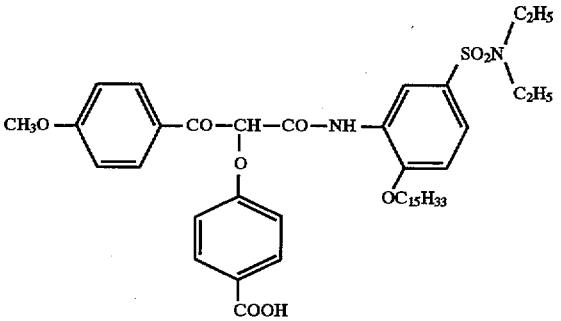

-continued
D-1
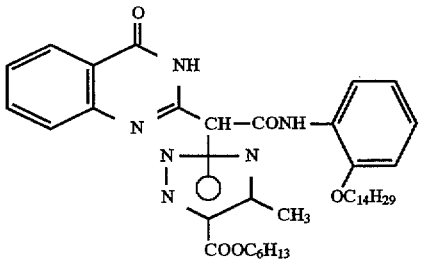
YC-1
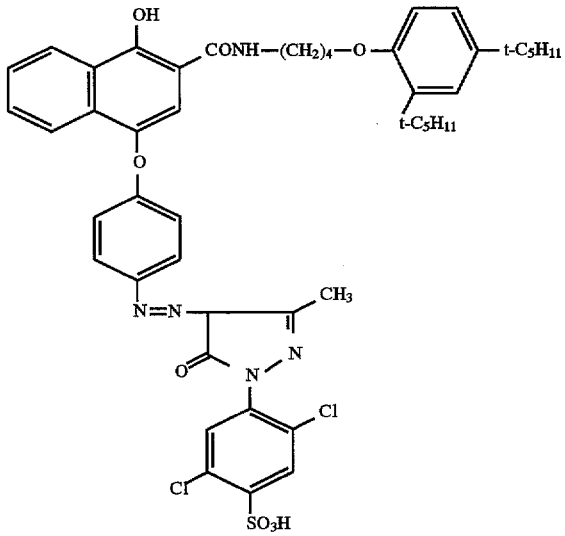
YM-2
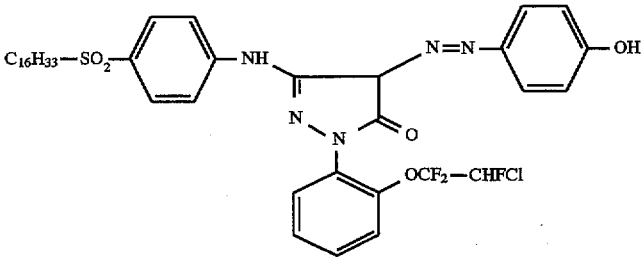
SC-1
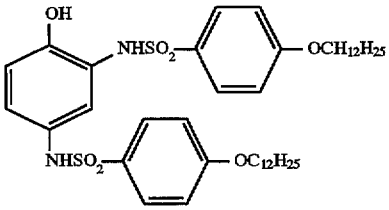
FF-1
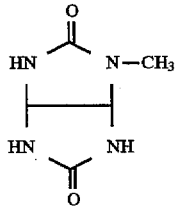

-continued

W-1

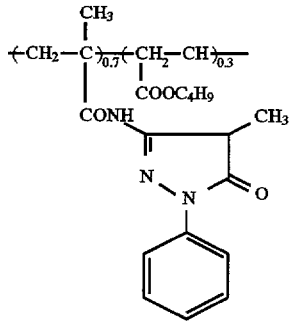

The material produced in this manner was exposed with an image and processeg using a colour negative process described in *The British Journal of Photography* 1974, pages 597 and 598. Colour densities, sensitivity and fog are shown in the following table.

TABLE 1

| | Relative sensitivity | | | Change in fog | | | Change in print density | |
|---|---|---|---|---|---|---|---|---|
| Example | Yellow | Magenta | Cyan | Yellow | Magenta | Cyan | Yellow | Cyan |
| 1 | 100 | 100 | 100 | — | — | — | — | — |
| 2 | 100 | 101 | 100 | 0 | 0 | 0 | 0 | 0 |
| 3 | 101 | 100 | 99 | 0 | 0 | 0 | 0 | 0 |
| 4 | 100 | 99 | 101 | 0 | 0 | +0.12 | 0 | +12.0 |
| 5 | 99 | 101 | 99 | 0 | +0.13 | 0 | −0.13 | −0.13 |
| 6 | 101 | 100 | 100 | +0.10 | 0 | 0 | +0.10 | 0 |
| Print density = | | | | | | | $D_{gb} - D_{pp}$ | $D_{bg} - D_{pp}$ |

for a grey exposure giving a magenta density of 0.5 above fog.
gb = yellow; pp = magenta; bg = cyan

EXAMPLES 2 TO 6

Layer structures were produced according to example 1, but with the following differences in layer 12:

| Layer 12: | | |
|---|---|---|
| Example 2 (comparison) | | |
| Additionally | 0.04 g | coupler C-1 |
| | 0.04 g | TCP |
| Example 3 (comparison) | | |
| Additionally | 0.05 g | $AgNO_3$ of a fogged AgClBr emulsion with 8 mol. % AgBr of an average grain diameter of 0.1 μm, not spectrally sensitised. |
| Example 4 (according to the invention) | | |
| Additionally | 0.05 g | $AgNO_3$ of the emulsion stated in example 3 |
| | 0.04 g | coupler C-1 |
| | 0.04 g | TCP |
| Example 5 (according to the invention) | | |
| Additionally | 0.05 g | $AgNO_3$ of the emulsion stated in example 3 |
| | 0.04 g | coupler M-2 |
| | 0.04 g | TCP |
| Example 6 (according to the invention) | | |
| Additionally | 0.05 g | $AgNO_3$ of the emulsion stated in example 3 |
| | 0.04 g | coupler Y-1 |
| | 0.04 g | TCP |

The results are shown in table 1.

We claim:

1. A color photographic silver halide material which comprises as photosensitive layers on a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, wherein at least one additional further layer is located on said support and further from said support than at least one of said photosensitive layers and said further layer contains 0.01 to 0.08 mmol of at least one colorless compound per $m^2$ which under processing conditions after exposure gives rise to a uniform, slight color density of 0.01 to 0.1 of a predetermined color over the entire surface and 0.2 to 0.6 mmol of a non spectrally sensitized, fogged Ag $Cl_{0.9-1.0}$ $Br_{0-0.1}$ emulsion per $m^2$, the particles of which have a diameter of a sphere of equal volume of 0.05 to 0.12 μm.

2. The color photographic silver halide material according to claim 1, wherein said colorless compound is a leuco dye which is used in a quantity of 0.01 to 0.8 mmol/$m^2$.

3. The color photographic silver halide material according to claim 1, wherein the further layer is arranged further from said support than the green-sensitive silver halide emulsion layer.

4. The color photographic silver halide material according to claim 1, wherein the further layer is arranged on the same side of the support and further from the support than the photosensitive layer furthest from the support.

* * * * *